US006212712B1

(12) United States Patent
Topp

(10) Patent No.: US 6,212,712 B1
(45) Date of Patent: Apr. 10, 2001

(54) MOBILE STRETCHER WITH LATERAL RECUMBANT MECHANISM

(76) Inventor: Richard Hardy Topp, 701 Palm Valley Dr., Harlingen, TX (US) 78550

( * ) Notice: Subject to any disclaimer, the term of this patent is extended or adjusted under 35 U.S.C. 154(b) by 0 days.

(21) Appl. No.: 09/295,254

(22) Filed: Apr. 20, 1999

(51) Int. Cl.[7] ..... A47B 7/00

(52) U.S. Cl. ..... 5/610; 5/634; 5/509.1; 5/628

(58) Field of Search ..... 5/607, 610, 628, 5/509.1, 634, 81.1 R

(56) References Cited

U.S. PATENT DOCUMENTS

| | | | | |
|---|---|---|---|---|
| 2,174,434 | | 9/1939 | Beaufour . | |
| 2,542,963 | | 2/1951 | Knox et al. . | |
| 3,259,922 | | 7/1966 | Fischer . | |
| 3,403,411 | | 10/1968 | Steinemann et al. . | |
| 3,640,520 | * | 2/1972 | Wieland et al. | 5/610 |
| 3,981,492 | * | 9/1976 | Hallmann | 5/81.1 R |
| 4,059,255 | * | 11/1977 | Perold | 5/610 |
| 4,458,370 | * | 7/1984 | Fickler | 5/634 X |
| 4,658,450 | | 4/1987 | Thompson . | |
| 4,939,801 | | 7/1990 | Schaal et al. . | |
| 4,947,418 | * | 8/1990 | Barr et al. | 5/607 X |
| 5,022,810 | | 6/1991 | Sherrow et al. . | |
| 5,926,876 | * | 7/1999 | Haigh et al. | 5/634 X |

FOREIGN PATENT DOCUMENTS

| | | |
|---|---|---|
| 2477 | 1/1911 | (GB) . |

* cited by examiner

*Primary Examiner*—Terry Lee Melius
*Assistant Examiner*—James M Hewitt
(74) *Attorney, Agent, or Firm*—Larry Mason Lee

(57) ABSTRACT

A mobile stretcher, having one or more lateral recumbant positioning devices, an upper base frame, a mattress frame, and a patient retention device. The mattress frame is pivotally connected to the upper base frame and each lateral recumbant positioning device has a retracted position and an extended position. When each lateral recumbant positioning device is in the retracted position the angle between the plane of the upper base frame and the plane of the mattress frame is an angle equaling zero. Conversely, when each lateral recumbant positioning device is in the extended position the angle between the plane of the upper base frame and the plane of the mattress frame is an angle greater than zero and preferably between 60° and 65°.

15 Claims, 8 Drawing Sheets

MOBILE STRETCHER WITH LATERAL RECUMBANT MECHANISM

BACKGROUND OF THE INVENTION

1. Field of Invention

The subject invention is related to an improved mobile stretcher, and more specifically to an improved mobile stretcher with a lateral recumbent positioning mechanism. The subject invention is more directly related to an improved mobile stretcher that tilts patients into a laterally raised position and secures the patients to the stretcher during and after tilting.

2. Description of the Related Art

Proper care of patients may require positioning, repositioning or transporting patients. Often the patient is non-ambulatory and must be situated in a specific position to perform medical examinations, surgery or other medical procedures. If the patient is non-ambulatory for a protracted period of time, it is often necessary to reposition the patient to avoid bed sores. In other instances the patient needs to be transported from one bed to another, or from a bed to a gurney or vice-versa. Mechanisms for positioning, repositioning, and transporting patients are well known in the prior art.

Devices for transferring non-ambulatory patients from one bed to another are disclosed in U.S. Pat. Nos. 2,174,434, 5,022,810, 2,542,963, 3,403,411 and G.B. 2477. U.S. Pat. Nos. 2,174,434, 3,403,411, 2,542,963 and G.B. 2477 all teach devices for handling non-ambulatory patients, where the device provides a side tilting platform to aid in transferring the non-ambulatory patient onto or off of a hospital bed. U.S. Pat. No. 5,022,810 also teaches a device for transferring a non-ambulatory patient from and to a hospital bed. U.S. Pat. No. 5,022,810 discloses a laterally sliding transfer platform in addition to a side tilting platform.

U.S. Pat. No. 4,658,450 teaches a multi-position bed for positioning a patient for ease of transportation or to allow certain medical procedures. Multiple linkages pivotally attached to the bed and bed frame allow the bed to be situated into the various positions. The bed can be adjusted to laterally position the patient, or to provide a backrest which raises the patient's torso and head.

U.S. Pat. No. 4,939,801 discloses a transporting and turning gurney for receiving and lifting a patient from a hospital bed, for transporting and depositing the patient on a hospital operating table, and for lifting and turning a patient for surgery. U.S. Pat. No. 4,939,801 teaches a rectangular frame (designed to receive a patient within the frame perimeter), a pair of support sheets, and a multiplicity of straps for supporting and attaching the patient to the frame. The frame can be rotated about its longitudinal axis for rotating the patient as needed.

There still exists a need to position a patient in a lateral recumbent position on a mobile bed or stretcher, and secure that patient to the mobile bed or stretcher while the patient is in a lateral recumbent position.

SUMMARY OF THE INVENTION

The current invention is of an improved mobile stretcher, comprising a first lateral recumbent positioning means, a second lateral recumbent positioning means, one or more casters, a lower base frame, one or more lifting arms, an upper base frame, a mattress frame, and a patient retention means. The casters are rotatably attached to the lower base frame and the lower base frame is connected to the upper base frame via the lifting arms. The lifting arms are extendable and retractable; when the lifting arms are in the extended and locked position the mattress frame is positioned above the lower base frame.

The upper base frame and the mattress frame each form rectangles and are pivotally connected to the other along one of the long ends of their rectangles. Cross bars are positioned inside the mattress frame and the upper base frames connecting the first and second long ends of the upper base frame rectangle and the first and second long ends of the mattress frame rectangle. The cross bars are parallel to the short ends of the upper base frame rectangle and the short ends of the mattress frame rectangle. The first lateral recumbent positioning means has a first end and a second end, and the first lateral recumbent positioning means first end is connected to one of the cross bars of the upper base frame. The first lateral recumbent positioning means second end is connected to one of the cross bars of the mattress frame. The second lateral recumbent positioning means also has a first end and a second end. The second lateral recumbent positioning means first end is connected to another cross bar of the upper base frame rectangle, and the second lateral recumbent positioning means second end is connected to another cross bar of the mattress frame rectangle.

Each of the lateral recumbent positioning means has a retracted position and an extended position so that when each of the lateral recumbent positioning means is in the retracted position the angle between each of the short ends of the upper base frame rectangle and each of the short ends of the mattress frame rectangle is an angle close to 0°. Accordingly, when the lateral recumbent positioning means is in the extended position the angle between each of the short ends of the upper base frame rectangle and each of the short ends of the mattress frame rectangle is an angle greater than zero. The preferred angle between each of the short ends of the upper base frame rectangle and each of the short ends of the mattress frame rectangle (i.e. the lateral recumbent position) is an angle between 60° and 65°.

It is therefore an object of this invention to provide an improved mobile stretcher with a lateral recumbent positioning mechanism.

It is yet a further object of this invention to provide an improved mobile stretcher with a lateral recumbent positioning mechanism and a means for securing a patient to the mobile stretcher.

BRIEF DESCRIPTION OF THE DRAWINGS

A better understanding of the present invention can be obtained from the detailed description of exemplary embodiments set forth below, to be considered in conjunction with the attached drawings, in which.

DESCRIPTION OF THE PREFERRED EMBODIMENTS

Figure 1:
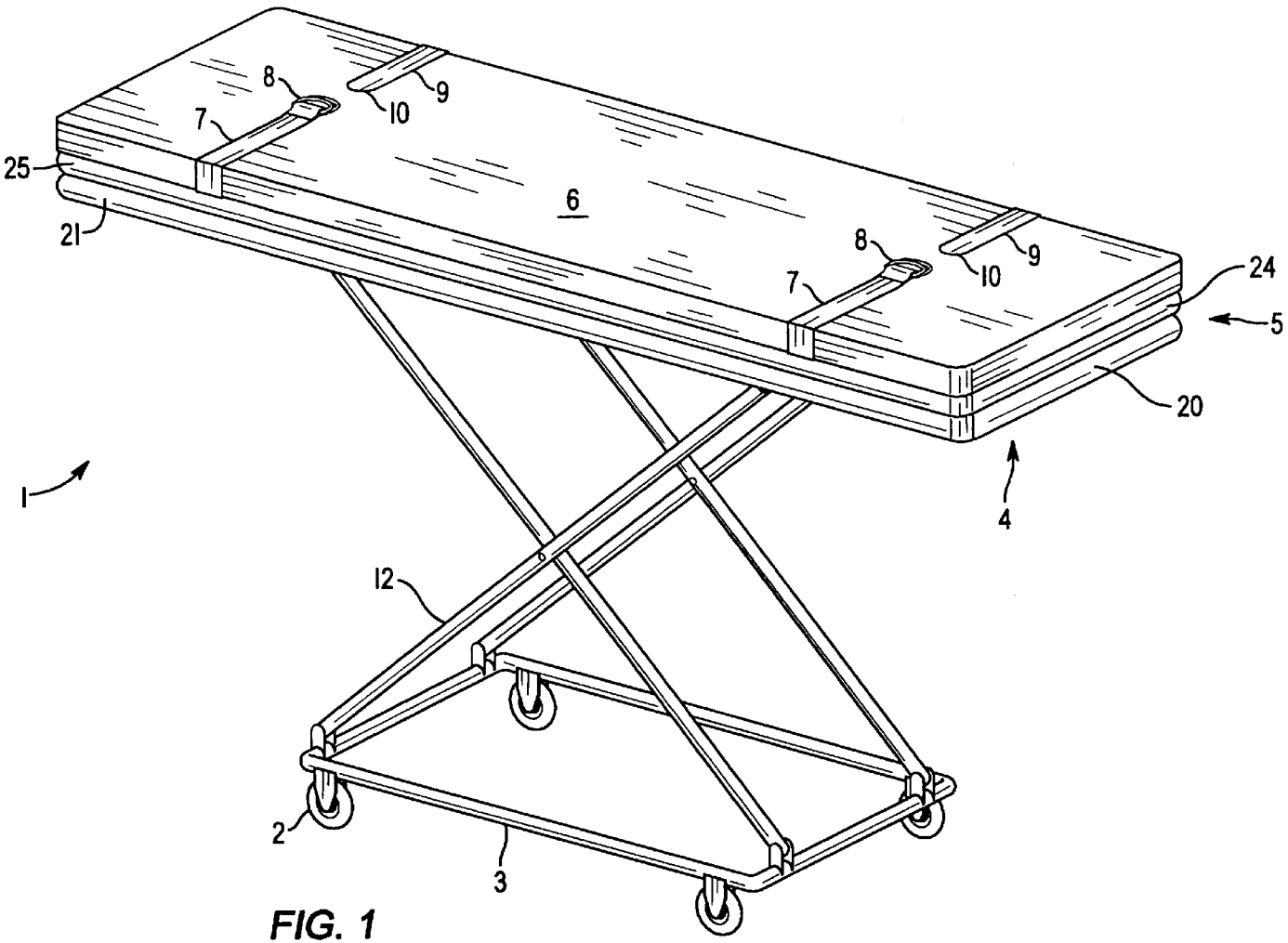
FIG. 1 depicts, in perspective view, the Improved Mobile Stretcher with a Lateral Recumbent Positioning Mechanism.
Figure 9:
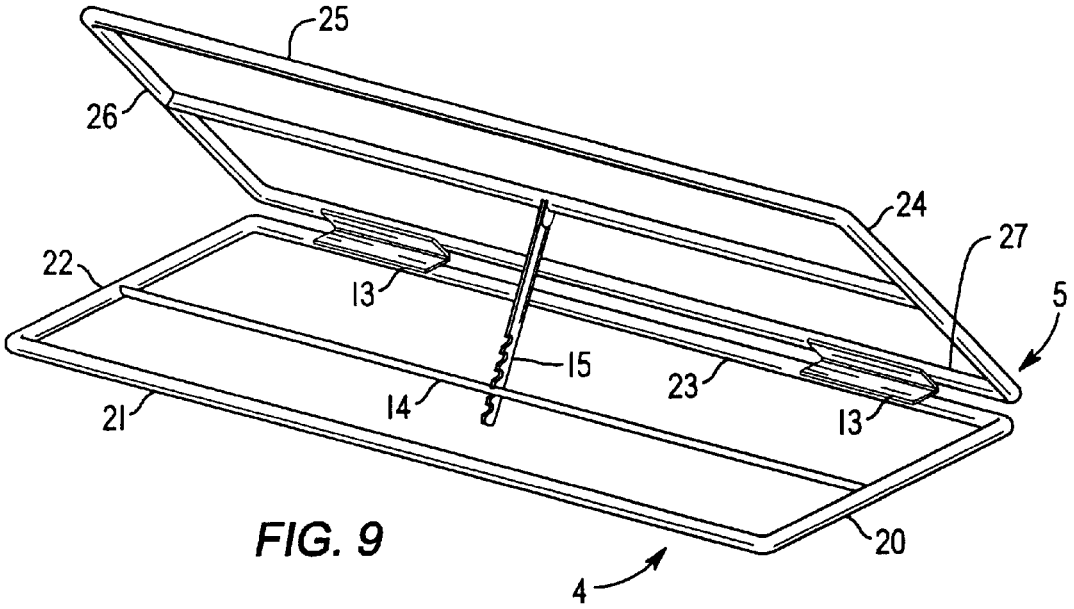
FIG. 9 depicts, in perspective view, the single bar embodiment of the lateral recumbent positioning mechanism.

FIG. 1 depicts in a perspective view, the Improved Mobile Stretcher with a Lateral Recumbent Positioning Mechanism 1 in the horizontal position. The Improved Mobile Stretcher with a Lateral Recumbent Positioning Mechanism 1 is comprised of a lower base frame 3 supported by casters 2. The lower base frame 3 is connected to the upper base frame 4 by a pair of lifting arms 12. The upper base frame 4 forms a rectangle comprised of an upper base first short member 20, an upper base second short member 22 (FIG. 2), an upper base first long member 21 and an upper base second long member 23 (FIG. 9). Resting on top of the upper base frame 4 is the mattress frame 5 such that the angle between the upper base frame 4 and the mattress frame 5 is an angle approximate to 0°. The mattress 6 is positioned atop the mattress frame 5. The mattress frame 5 forms a rectangle having a mattress frame first long member 25, a mattress frame second long member 27 (FIG. 9), a mattress frame first short member 24 and a mattress frame second short member 26 (FIG. 9). Connected to the mattress frame first and second long members (25 and 27) is the patient retention means consisting of a pair of strap assemblies each pair comprising a first strap 7 and a second strap 9. The pair of first straps 7 is connected to the mattress frame first long member 25 at each first strap 7 first end. A female buckle assembly is secured to the first strap 7 second end. The pair of second straps 9 are connected to the mattress frame second long member 27 at each second strap 9 first end. A male buckle assembly is connected to the second strap 9 second end. While it is preferred that three strap assemblies with head straps be used, the strap assemblies may be comprised of one strap assembly, two strap assemblies, or more than three strap assemblies. Additionally, while the preferred mode of connecting the first strap 7 to the second strap is a male/female seat belt buckle assembly 8, any number of other types of assemblies may be employed, such as Velcro® hook and loop fasteners, traditional self locking belt buckle assemblies, D-shaped rings, mating male and female snaps or hooks.

Figure 2:
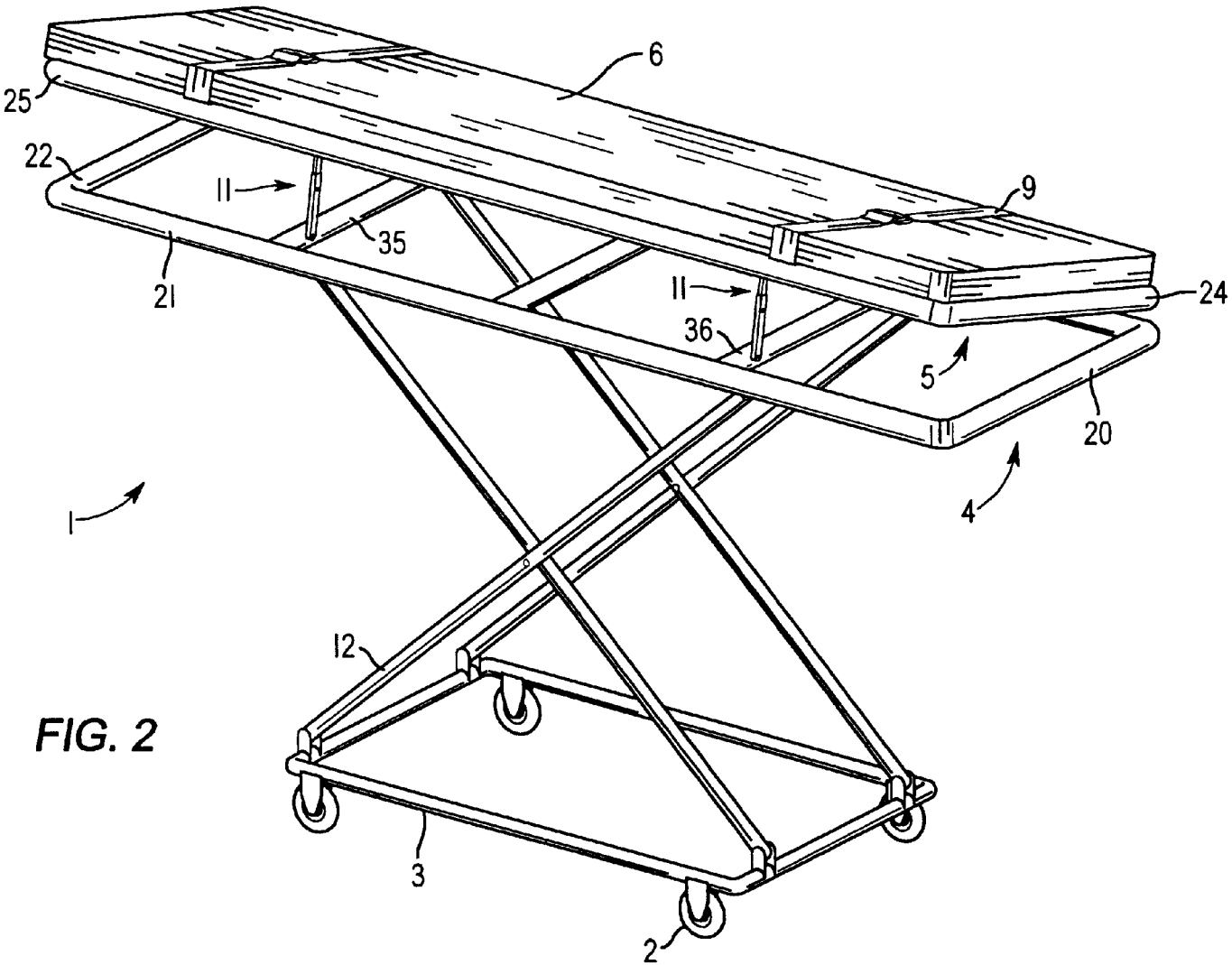
FIG. 2 depicts, in perspective view, the Improved Mobile Stretcher with a Lateral Recumbent Positioning Mechanism in the lateral recumbent position.

FIG. 2 illustrates in perspective view the Improved Mobile Stretcher with a Lateral Recumbent Positioning Mechanism 1 in the lateral recumbent position. In the lateral recumbent position the mattress frame 5, and accordingly the mattress 6, are at approximately a 60° to 65° angle to the upper base frame 4. The mattress frame 5 is supported and held steady at the approximately 60° to 65° angle by the lateral recumbent positioning mechanism 11. When the mattress frame 5 is in the approximately 60° to 65° angle with respect to the upper base frame 4 the lateral recumbent positioning mechanism 11 is in the extended position. Conversely, when the mattress frame 5 is in the approximately 0° angle with respect to the upper base frame 4, the lateral recumbent positioning mechanism 11 is in the retracted position. Due to cost and ease of construction it is preferred to construct the lateral recumbent positioning mechanism 11 from metals such as aluminum, carbon steel or stainless steel. However, plastics or composites may be used that are of sufficient strength to support the required loads. The standard in the industry is that a stretcher be able to support at least 500 pounds. It is preferred that the lateral recumbent positioning mechanism 11 be a multi-piece mechanism with multiple degrees of freedom in order to retract when the Improved Mobile Stretcher with a Lateral Recumbent Positioning Mechanism 1 is in the horizontal position and to be able to extend and lock when the Improved Mobile Stretcher with a Lateral Recumbent Positioning Mechanism 1 is in the lateral recumbent position. However, the lateral recumbent positioning mechanism 11 may be any device capable of extending and supporting the mattress frame 5 in its 60° to 65° angle and retracting when the mattress frame 5 is in the horizontal position (0° angle). Accordingly, the lateral recumbent positioning mechanism 11 may also be a cylinder and piston device that is gas, hydraulically, electrically or mechanically actuated.

Figure 3:
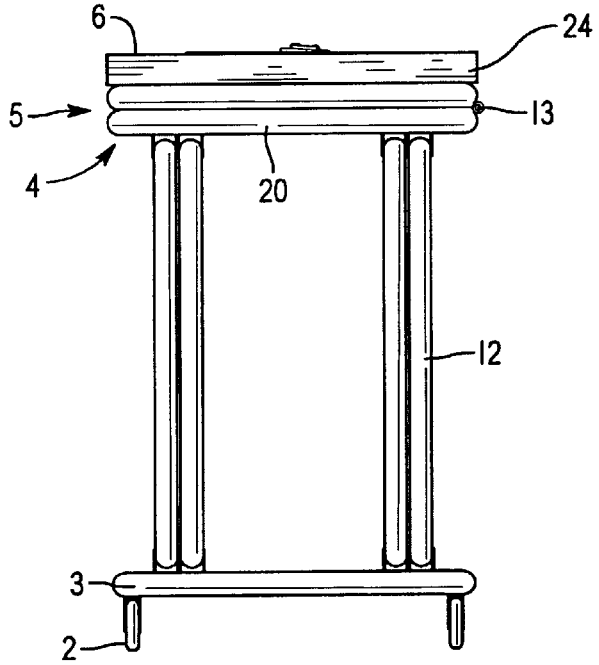
FIG. 3 depicts, in a side view, the Improved Mobile Stretcher with a Lateral Recumbent Positioning Mechanism.

FIG. 3 illustrates in side view the Improved Mobile Stretcher with a Lateral Recumbent Positioning Mechanism 1 in the horizontal position. The hinge mechanism 13 pivotally connects the upper base frame second long member 23 (FIG. 9) to the mattress frame second long member 27 (FIG. 9).

Figure 4:
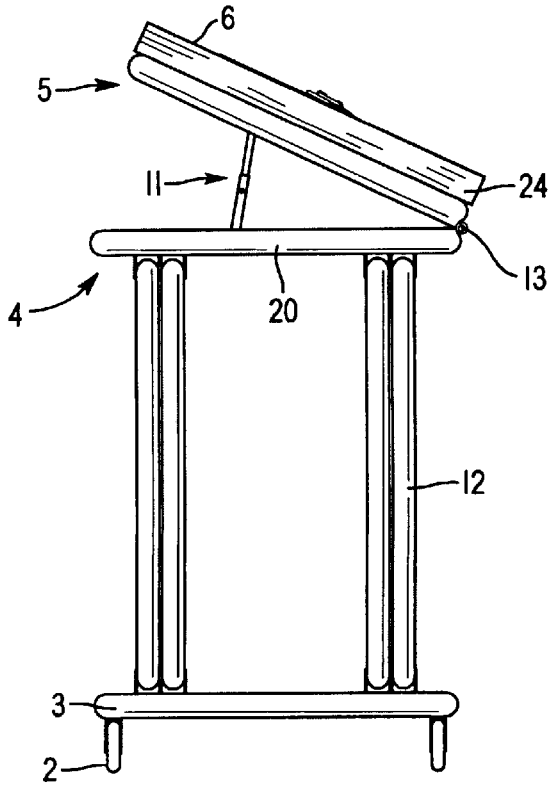
FIG. 4 depicts, in a side view, the Improved Mobile Stretcher with a Lateral Recumbent Positioning Mechanism, in the lateral recumbent position.
Figure 5:
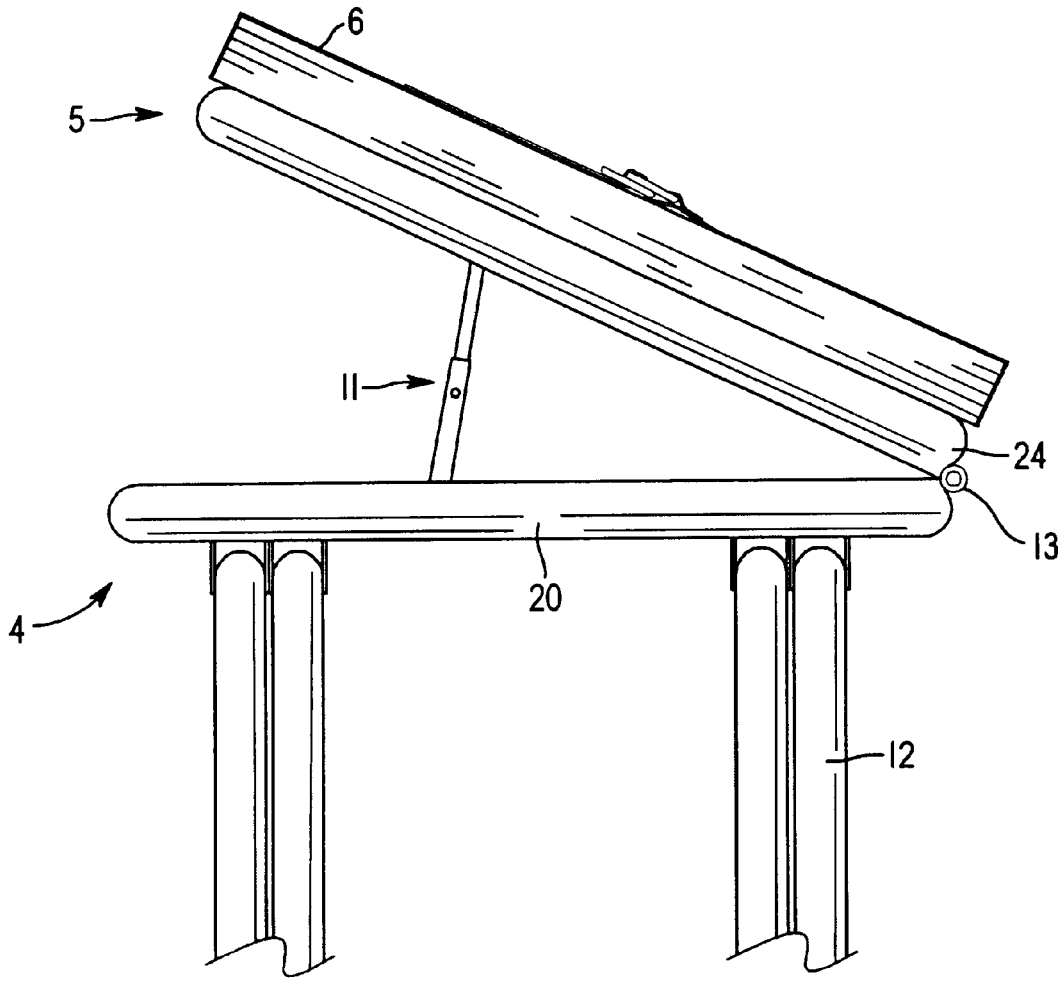
FIG. 5 depicts, in a side view, the Improved Mobile Stretcher with a Lateral Recumbent Positioning Mechanism, in an intermediate recumbent position. Lateral Recumbent Positioning Mechanism in the lateral recumbent position.
Figure 6:
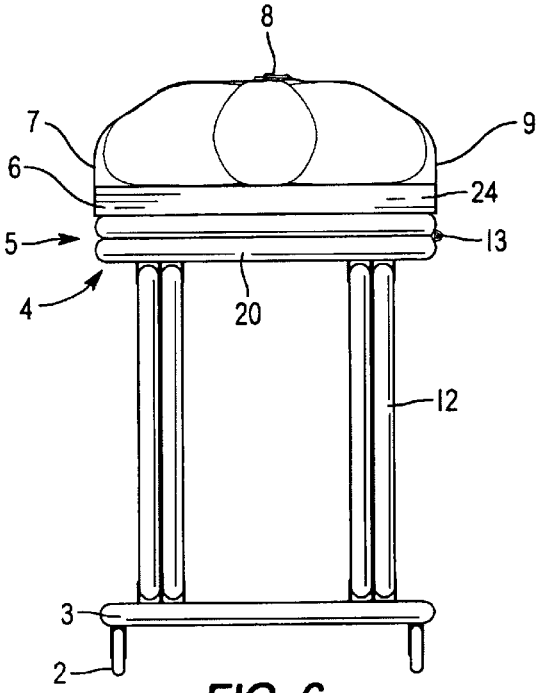
FIG. 6 depicts, in a side view, a patient secured to the Improved Mobile Stretcher with a Lateral Recumbent Positioning Mechanism.
Figure 7:
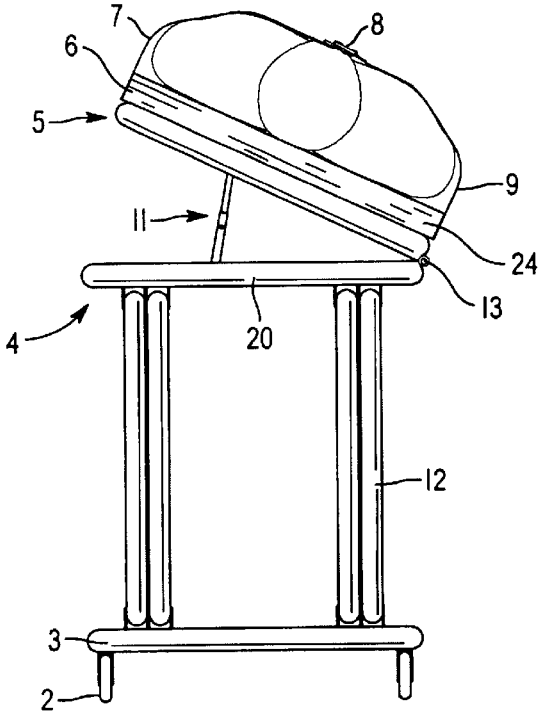
FIG. 7 depicts, in a side view, a patient secured to the Improved Mobile Stretcher with a Lateral Recumbent Positioning Mechanism, in the lateral recumbent position.

FIG. 4 illustrates in side view the Improved Mobile Stretcher with a Lateral Recumbent Positioning Mechanism 1 in the lateral recumbent position. The hinge mechanism 13 rotatably connects the upper base frame second long member 23 (FIG. 9) to the mattress frame second long member 27 (FIG. 9) and provides a point which the mattress frame 5 is allowed to pivot about the upper base frame 4.

It is well understood in the medical profession that placement of a patient into a lateral recumbent position is beneficial in that an unconscious or incapacitated patient is susceptible to strangulation upon or drowning in the patient's own regurgitated materials. The lateral recumbent position is understood to be that position wherein the patient is lying on his side. It has been determined and is commonly accepted medical knowledge that a lateral recumbent position wherein the plane of the patient's back makes an angle of approximately 60° to 65° with respect to the horizon is optimal, in that gravity will work to clear the patient's air passage while the patient is in this position.

In operation, the attending medical personnel position the patient onto the mattress 6 and secure the patient thereto by connecting the series of first straps 7 to the series of second straps 9. The preferred connection mechanism to connect the series of first straps 7 to the series of second straps 9 is a male/female buckle assembly 8. Typical male/female buckle assemblies 8 are utilized on current mobile stretchers. The male/female buckle assemblies 8 are preferred since they are quick and easy to connect and disconnect. If it is necessary, or anticipated, that the patient be positioned into the lateral recumbent position, the attending medical personnel can raise the mattress frame first long member 25 away from the upper base frame first long member 21 to the desired position, typically until approximately a 60° to 65° angle exists between the upper base frame short members (20 and 22) and the mattress frame short members (24 and 26). The lateral recumbent positioning mechanism 11 is then secured into a locked position to maintain the approximate 60° to 65° angle between the upper base frame short members (20 and 22) and the mattress frame short members (24 and 26) for as long as necessary. Often the patients are attended to by emergency medical personnel and the care provided must be fast and efficient. It is important that the lateral recumbent positioning mechanism 11 can be positioned in the locked position easily—preferably in a single motion, and be self locking.

Figure 8:
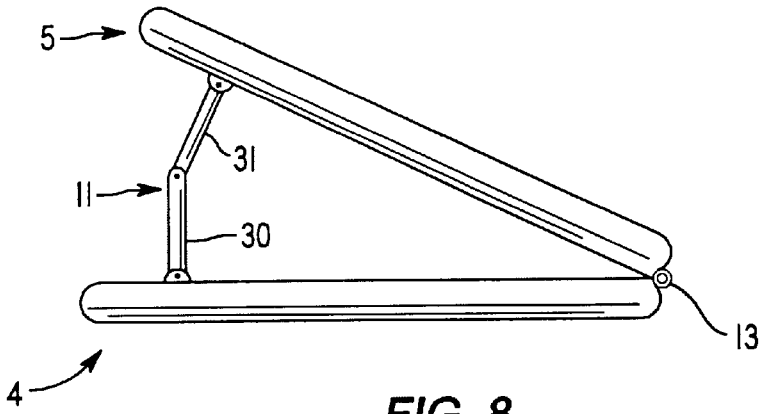
FIG. 8 depicts the side view of a two bar linkage embodiment of the lateral recumbent positioning mechanism.

Various embodiments of the lateral recumbent positioning mechanism 11 exist. FIG. 8 depicts the two bar linkage embodiment of the lateral recumbent positioning mechanism 11. The two bar linkage embodiment is comprised of a first member 30 and a second member 31 pivotally connected to each other on one end. The second member 31 is pivotally connected to the upper base frame cross bars (35 and 36) on its other end, and the first member 30 is pivotally connected to the upper base frame 4 on its other end. The pivoting connections allow the first member 30 and the second member 31 to be positioned substantially parallel to one another when the lateral recumbent positioning mechanism 11 is in the retracted position. Conversely, when the lateral recumbent positioning mechanism 11 is in the extended position the major axis of each of the first member 30 and the second member 31 lie on the same line, and the length of the recumbent positioning mechanism 11 is approximately the sum of the lengths of the first member 30 and the second member 31. Further, when the lateral recumbent positioning mechanism 11 is in the extended position, the first member 30 and the second member 31 lock into position and tilt the mattress frame 5 with respect to the upper base frame 4. The first member 30 and the second member 31 will not return to the retracted position until an external force is applied to the point about which the first member 30 and the second member 31 are connected to each other.

FIG. 9 illustrates a single bar 15 linkage embodiment of the lateral recumbent positioning mechanism. The single bar 15 is pivotally connected along the plane defined by the mattress frame 5 and is formed having multiple notches along the length of the single bar 15. The multiple notches are each formed for mating with the cross bar 14 so that when any of the notches is positioned around the cross bar 14 the mattress frame 5 is tilted with respect with the upper base frame 4. Providing multiple notches on the single bar 15 allows multiple angles of tilt between the mattress frame 5 and the upper base frame 4. The single bar 15 linkage embodiment can be unlocked by simply lifting the mattress frame 5 upwards and the single bar 15 will demate from the cross bar 14.

Figure 10:
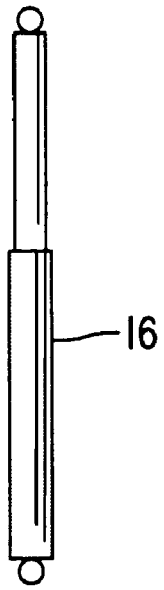
FIG. 10 illustrates the piston/cylinder embodiment of the lateral recumbent positioning mechanism.
Figure 11:
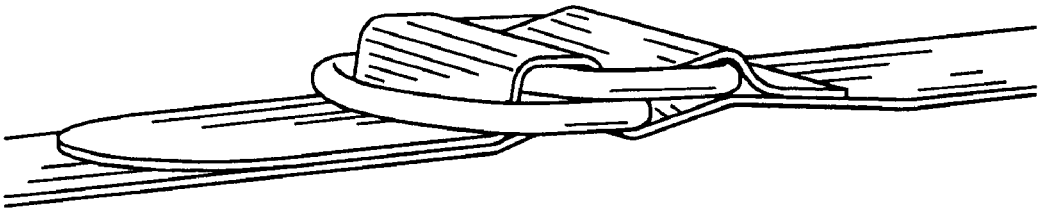
FIG. 11 illustrates the D-shaped ring embodiment of the strap connection means.

FIG. 10 depicts a piston/cylinder 16 arrangement of the lateral recumbent positioning mechanism. The piston/cylinder 16 may contain a compressed gas, hydraulic fluid or a mechanical device. The preferred compressed gas is air, however any suitable gas may be employed, such as nitrogen. The preferred mechanical device contained inside the piston/cylinder 16 is a spring, however alternatively facing stacked washers may be employed as well.

Figure 12:
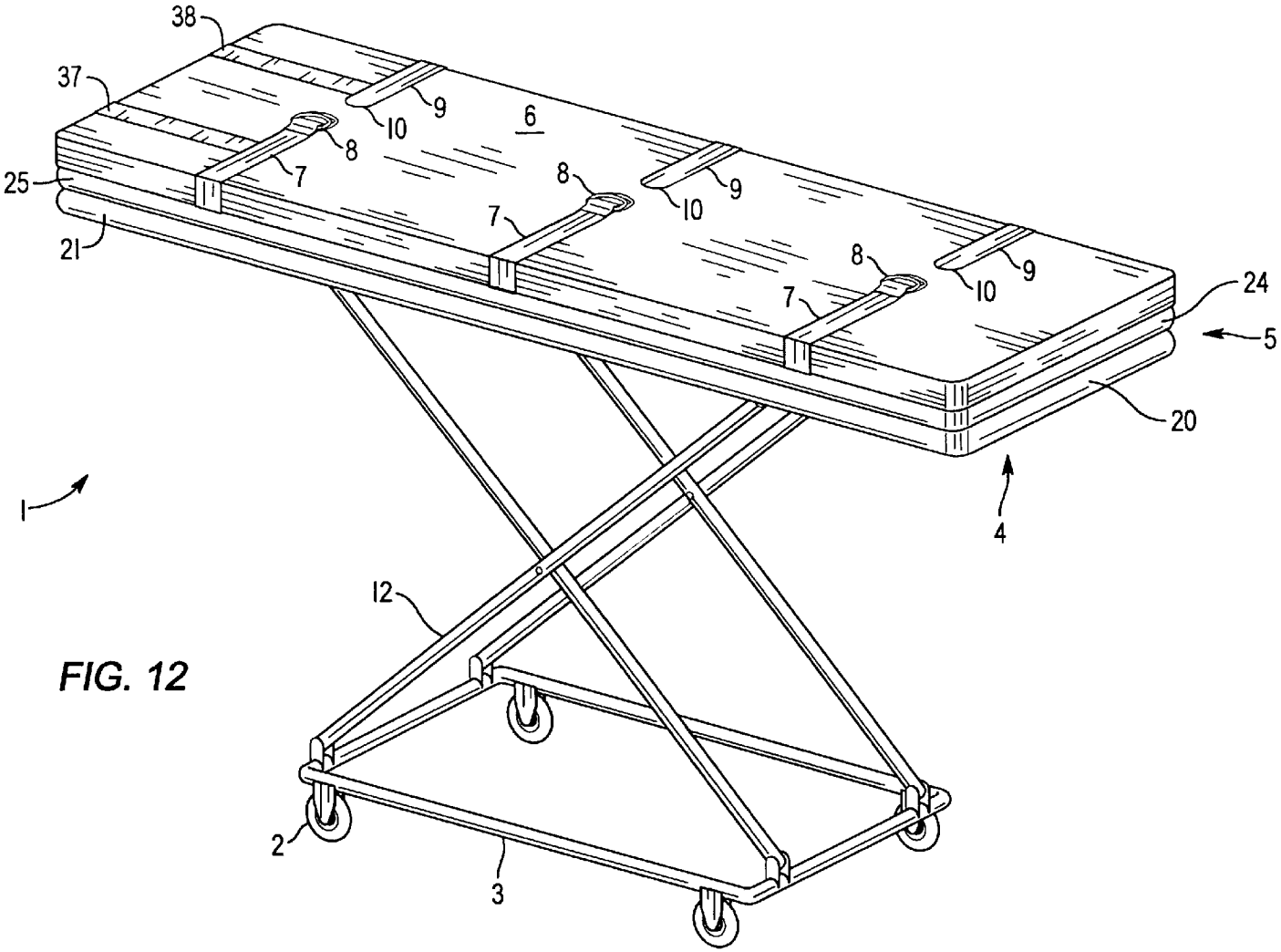
FIG. 12 depicts an alternative embodiment of the present invention.

In FIG. 12 an alternative embodiment of the patient retention means is illustrated. Head straps 37 and 38 are connected to a first strap 7 and a second strap 9 and an additional first strap 7 and second strap 9 are shown. Also shown is an additional connection means.

When the patient is in the lateral recumbent position the risk that the patient will choke on his or her own fluids, such as from regurgitation, is significantly reduced. Therefore, if the patient is otherwise stable, the attending medical staff may give reduced priority to monitoring the subject patient for choking from said fluids and the attending medical staff is able to engage in other medical care tasks.

The foregoing disclosure and description of the invention is illustrative and explanatory thereof, and various changes in the size, shape, and materials, as well as in the details of the illustrated and described invention may be made without departing from the spirit of the invention.

What is claimed is:

1. A mobile stretcher comprising a lower base frame, an upper base frame, a pair of lifting arms, casters, a mattress frame, a mattress, one or more elevating means, and one or more retaining means, wherein said mattress lies on top of said mattress frame, said mattress frame is attached to said upper base frame, said pair of lifting arms are connected to a lower side of said upper base frame, said pair of lifting arms are connected to an upper side of said lower base frame, said casters are connected to said lower side of said lower base frame, said mattress frame is rectangular and comprises two long members and two short members, a first one of said two long members is pivotally connected to said upper base frame, said elevating means includes a first end and a second end, said first end of said elevating means is connected to said upper base frame, said second end of said elevating means is connected to said mattress frame, said elevating means provides a retracted position, said elevating means provides an extended position, and said retaining means acts to retain a patient on said mattress; whereby when said elevating means is in said retracted position, said upper base frame and said mattress frame form an angle of approximately 0°, and when said elevating means is in said extended position, said upper base frame and said mattress frame form an angle greater than 0°.

2. The mobile stretcher of claim 1 wherein said elevating means comprises a first member and a second member, said first member provides a first member first end and a first member second end, said second member provide a second member first end and a second member second end, said first member is pivotally attached at said first member first end to said upper base frame, said first member is pivotally and lockably attached at said first member second end to said second member first end, said second member second end is pivotally attached to said mattress frame; and wherein said first member first end constitutes said elevating means first end, and wherein said second member second end constitutes said elevating means second end.

3. The mobile stretcher of claim 1 wherein said elevating means is comprised of a support member pivotally attached to said mattress frame, and said support member provides multiple attachment locations along said support member for detachable attachment to said upper base frame, and wherein said upper base frame is attached at one of said multiple attachment locations.

4. The mobile stretcher of claim 1 wherein said angle between said upper base frame and said mattress frame is between 60° and 65° when said elevating means is in said extended position.

5. The mobile stretcher of claim 1 wherein said retaining means is comprised of
a plurality of first straps,
a plurality of second straps, and
a strap connection means;

said strap connection means acts to connect said first straps to said second straps, said first straps provide first ends and second ends, said first straps' first ends are connected to said mattress frame, said first straps' second ends are connected to said strap connection means, said second straps provide first ends and second ends, said second straps' first ends are connected to said mattress frame, and said second straps' second ends are connected to said strap connection means.

6. The mobile stretcher of claim 5, wherein said strap connection means is comprised of a hook and loop fastener.

7. The mobile stretcher of claim 5, wherein said strap connection means is comprised of a male/female buckle assembly.

8. The mobile stretcher of claim 5, wherein said strap connection means is comprised of a self-locking buckle member.

9. The mobile stretcher of claim 5, wherein said strap connection means is comprised of a plurality of substantially D-shaped rings.

10. The mobile stretcher of claim 5, wherein said strap connection means is comprised of a series of mating male and female snap fasteners.

11. The mobile stretcher of claim 5 further comprising head straps.

12. A mobile stretcher, comprising one or more lateral recumbent positioning means, one or more casters, a lower base frame, one or more lifting arms, an upper base frame, a mattress frame, a mattress, and a retention means, wherein said mattress lies on top of said mattress frame, said casters are rotatably attached to said lower base frame, said lower base frame is connected to said upper base frame by said lifting arms, said lifting arms are extendable and retractable, said upper base frame is rectangular in shape, said upper base frame comprises a first short member, a second short member, a first long member and a second long member, said mattress frame is rectangular in shape, said mattress frame is comprised of a first short member, a second short member, a first long member and a second long member, said mattress frame's second long member is pivotally connected to said upper base frame's second long member, said retention means acts to retain a patient lying upon said mattress when said mattress frame is elevated into a lateral recumbent position, said lateral recumbent positioning means acts to elevate said mattress frame, the mattress lying on top of said mattress frame and any patient lying on said mattress, into a lateral recumbent position, said lateral recumbent positioning means comprises a first end and a second end, whereby said lateral recumbent positioning means' first end is connected to said upper base frame, said lateral recumbent positioning means' second end is connected to said mattress frame, and said lateral recumbent positioning means provides a retracted position and an extended position;

whereby when said lateral recumbent positioning means is in said retracted position the angle between said upper base frame short member and said mattress frame short member is an angle equaling zero, and when said lateral recumbent positioning means is in said extended position the angle between said upper base frame short member and said mattress frame short member is an angle greater than zero.

13. The mobile stretcher of claim 12, wherein said lateral recumbent positioning means provides a first member and a second member, said first member provides a first member first end and a first member second end, said second member provides a second member first end and a second member second end, said first member's first end is pivotally attached to said upper base frame, said first member's second end is pivotally attached to said second member's first end, and said second member's second end is pivotally attached to said mattress frame; and wherein said first member first end constitutes said lateral recumbent positioning means first end, and wherein said second member second end constitutes said lateral recumbent positioning means second end.

14. The mobile stretcher of claim 12, wherein said lateral recumbent positioning means is comprised of a support member pivotally attached to said mattress frame, and said support member provides multiple attachment locations along said support member for detachable attachment to said upper base frame and wherein said upper base frame is attached at one of said multiple attachment locations.

15. The mobile stretcher of claim 12 wherein said angle between said upper base frame's short member and said mattress frame's short member is between 60° and 65°.

* * * * *